US005547105A

United States Patent [19]

Oden et al.

[11] Patent Number: 5,547,105

[45] Date of Patent: Aug. 20, 1996

[54] CAN VENDING MECHANISM

[75] Inventors: Kenneth W. Oden, Charles Town; Michael D. Ring, Kearneysville, both of W. Va.

[73] Assignee: Royal Vendors, Inc., Kearneysville, W. Va.

[21] Appl. No.: 324,501

[22] Filed: Oct. 18, 1994

[51] Int. Cl.[6] ..... G07F 11/08

[52] U.S. Cl. ..... 221/181; 221/281; 221/311

[58] Field of Search ..... 221/75, 131, 258, 221/261, 263, 277, 281, 311, 6, 14, 17, 18

[56] References Cited

U.S. PATENT DOCUMENTS

| | | | |
|---|---|---|---|
| 2,585,011 | 2/1952 | Johnson . | |
| 2,814,417 | 11/1957 | Johnson . | |
| 2,825,488 | 3/1958 | Nelson . | |
| 3,270,916 | 9/1966 | Lyman | 221/6 |
| 3,464,589 | 9/1969 | Oden . | |
| 4,426,016 | 1/1984 | Croteau et al. | 221/75 |
| 4,456,147 | 6/1984 | Tominaga . | |
| 4,722,455 | 2/1988 | Groover . | |
| 5,111,962 | 5/1992 | Oden . | |
| 5,167,345 | 12/1992 | Bleeker | 221/131 |
| 5,176,287 | 1/1993 | Suris | 221/131 |
| 5,176,288 | 1/1993 | Craven . | |

FOREIGN PATENT DOCUMENTS

| | | | |
|---|---|---|---|
| 2041390 | 9/1980 | European Pat. Off. | 221/6 |
| 1449258 | 3/1964 | Germany | 221/131 |
| 4110368 | 10/1992 | Germany | 221/131 |
| 3233795 | 10/1991 | Japan | 221/6 |
| 4199494 | 7/1992 | Japan | 221/281 |

*Primary Examiner*—William E. Terrell
*Assistant Examiner*—T. Kelly
*Attorney, Agent, or Firm*—Popham, Haik, Schnobrich & Kaufman, Ltd.

[57] ABSTRACT

A can vending mechanism comprising a module containing three vertically-extending channels arranged front-to-back and dimensioned to vend cylindrical products, such as cans, with their longitudinal axes parallel to the front face of a vending machine to achieve greater product capacity. A sold-out switch is provided in each channel. Each sold out switch is activated when two products remain in escrow at the bottom of its respective channel. The channels are refilled without the use of diverters by dropping new products into the channels. The two products remaining in escrow at the bottom of each channel absorb the shock of the falling products.

18 Claims, 3 Drawing Sheets

CAN VENDING MECHANISM

BACKGROUND OF THE INVENTION

1. Field of the Invention

The present invention relates to a vending mechanism. More specifically, the invention relates to a new vending mechanism for top-loading cylindrical products, such as cans, into a vending machine without the use of diverters by dropping the products into the vending mechanism with their longitudinal axes parallel to the front face of the vending machine.

2. Related Art

U.S. Pat. No. 4,722,455 to Groover discloses a vending rack comprising first columns for supporting products in vertical stacks with the longitudinal axes of the products orthogonal to the vending machine face, and second columns for supporting products in vertical stacks with the longitudinal axes parallel to the vending machine face. The products with axes parallel to the vending machine face are supported on slide-out racks for loading products therein.

U.S. Pat. No. 5,176,288 to Craven discloses a dispensing apparatus for vending machines including at least one motor-driven auger mounted in an almost horizontal position in relation to cylindrical products rolling down a shallow slope to control storing, feeding, and dispensing of the cylindrical products.

U.S. Pat. No. 5,111,962 to Oden discloses a vending apparatus and a controller therefor to insure that the delay between a customer's selection of an article and the dispensation of the selected article is minimized. The disclosed systems and methods also insure that articles are dispensed at a proper temperature, even after a "sold-out" condition is corrected, and activate an alarm if a person jars the vending apparatus. At column 2, lines 7–19, a prior art vending apparatus is described in which two articles are retained in escrow when the sold out switch is activated, in order to ensure that the first two articles rended after refilling are dispensed at the proper temperature. These bottom two articles are positioned in a generally-horizontal array, one behind the other.

U.S. Pat. No. 4,456,147 to Tominaga shows a vending machine having gravity-fed storage chambers with displaceable supporting track segments.

U.S. Pat. No. 2,825,488 to Nelson shows a vending machine comprising a plurality of magazines, each adapted to support a plurality of cans filled with a selected product, and means for circulating conditioned air through the magazines to heat the contents of the can supported thereon to a predetermined temperature.

U.S. Pat. No. 2,814,417 to Johnson discloses a sequential feeding mechanism for vertically-stacked cylindrical articles in side-by-side magazines. The feeding mechanism comprises an operation shaft having a plurality of compound screws thereon which feed the articles to be dispensed from the bottom of each stack.

U.S. Pat. No. 2,585,011 to Johnson discloses an automatic vending machine for articles of merchandise with the articles maintained in a plurality of vertical stacks that are relatively staggered. Dispensing means underline the stacks and are moveable alternately from one stack to the other for dispensing the articles at one time.

In the above prior art vending mechanisms, cylindrical products are loaded with their longitudinal axes parallel to the front face of a vending machine. The products therefore cannot be top-loaded (dropped into the top of a vending machine and loaded by gravity alone). Rather, prior art vending mechanisms require either serpentine-type diverters or a pull out vend rack for loading cylindrical products with their longitudinal axes parallel to the front face of a vending machine. It is therefore desirable to provide a vending mechanism that allows products to be top-loaded into a vending machine with their longitudinal axes parallel to the front face of the vending machine in either single or multiple stacks without the use of diverters or a pull out rack. It is also desirable to provide such a vend mechanism that is inexpensive to manufacture and has increased product capacity.

SUMMARY OF THE INVENTION

The present invention provides a vending mechanism that allows cylindrical products, such as cans, to be top-loaded into a vending machine without the use of diverters and stored in multiple stacks with their longitudinal axes parallel to the front face of the vending machine. This vending mechanism allows for increased product capacity over prior art vend mechanisms and is inexpensively manufactured.

The inventive vending mechanism comprises a module having front, middle, and rear vertically-extending channels arranged front-to-back in parallel relation. A sold-out switch, preferably a conventional micro-switch, is provided in each channel to indicate that the channel needs to be refilled when two products remain in escrow at the bottom of the channel. New products can then be top-loaded into the channel by dropping them into the upper end of the channel so that they fall through the channel by gravity without the use of diverters. The two products remaining in escrow at the bottom of the channel are arrayed in a generally vertical stack and absorb the shock of the top-loaded products.

Each channel is preferably dimensioned to allow multiple stacks of products, such as double or triple stacks, to be stored therein. Typically, for vending cans, six modules are placed side-by-side in parallel relation in a vending machine to yield an increased can capacity over prior art vending mechanisms of about 35% more cans per cubic foot of refrigerated cabinet space.

According to a first embodiment of the invention, each channel has a depth of approximately five inches to allow double stacks of cylindrical products to be loaded in each channel with their longitudinal axes parallel to the front of the vending machine. The products are rended by means of a helical screw (helix) having a pitch slightly larger than the major diameter of the product to be vended. A motor attached to the helix operates the helix to vend a product whenever a customer deposits the correct amount of money in the vending machine. An impact sensor as disclosed in U.S. Pat. No. 5,111,962 to Oden is used to detect and terminate the vend. The event cycle is terminated when the sensor detects that a product has impacted the vending machine delivery chute.

A sold-out switch is offset from the bottom of each channel, so that when two products remain in escrow at the bottom of a channel, the channel's sold-out switch is activated. The channel can be reloaded by dropping new products into a vend slot located at the upper end of the channel. The two products remaining in escrow at the bottom of the channel absorb the shock of the falling products. This embodiment, when used for vending cans from a vending machine provided with six of the inventive modules, has a can capacity of about 582 cans.

According to a second embodiment of the invention, at least the rear channel is extended so that it is approximately seven inches deep to allow triple stacks of cylindrical products to be contained therein. The front and middle channels can likewise be extended. The products are vended and the channels are reloaded as described above in relation to the first embodiment of the invention. This embodiment, when used for vending cans from a machine provided with six of the inventive modules, provides an even greater can capacity of about 636 cans.

Providing six of the inventive modules in a vending machine, each module having three channels formed therein, allows for 18 different vend mechanisms in the vending machine. Thus, it is possible to vend 18 different products from a single machine and to provide 18 different selection buttons corresponding to the products on the machine. Preferably, approximately 10 selection buttons are provided on a machine and any combination of columns can be associated with the ten selection buttons to allow a good space-to-sales ratio of the products to be vended.

BRIEF DESCRIPTION OF THE DRAWINGS

The invention is better understood by reading the following Detailed Description of the Preferred Embodiments with reference to the accompanying drawing figures, in which like reference numerals refer to like elements throughout, and in which.

DETAILED DESCRIPTION OF THE PREFERRED EMBODIMENTS

Figure 1:
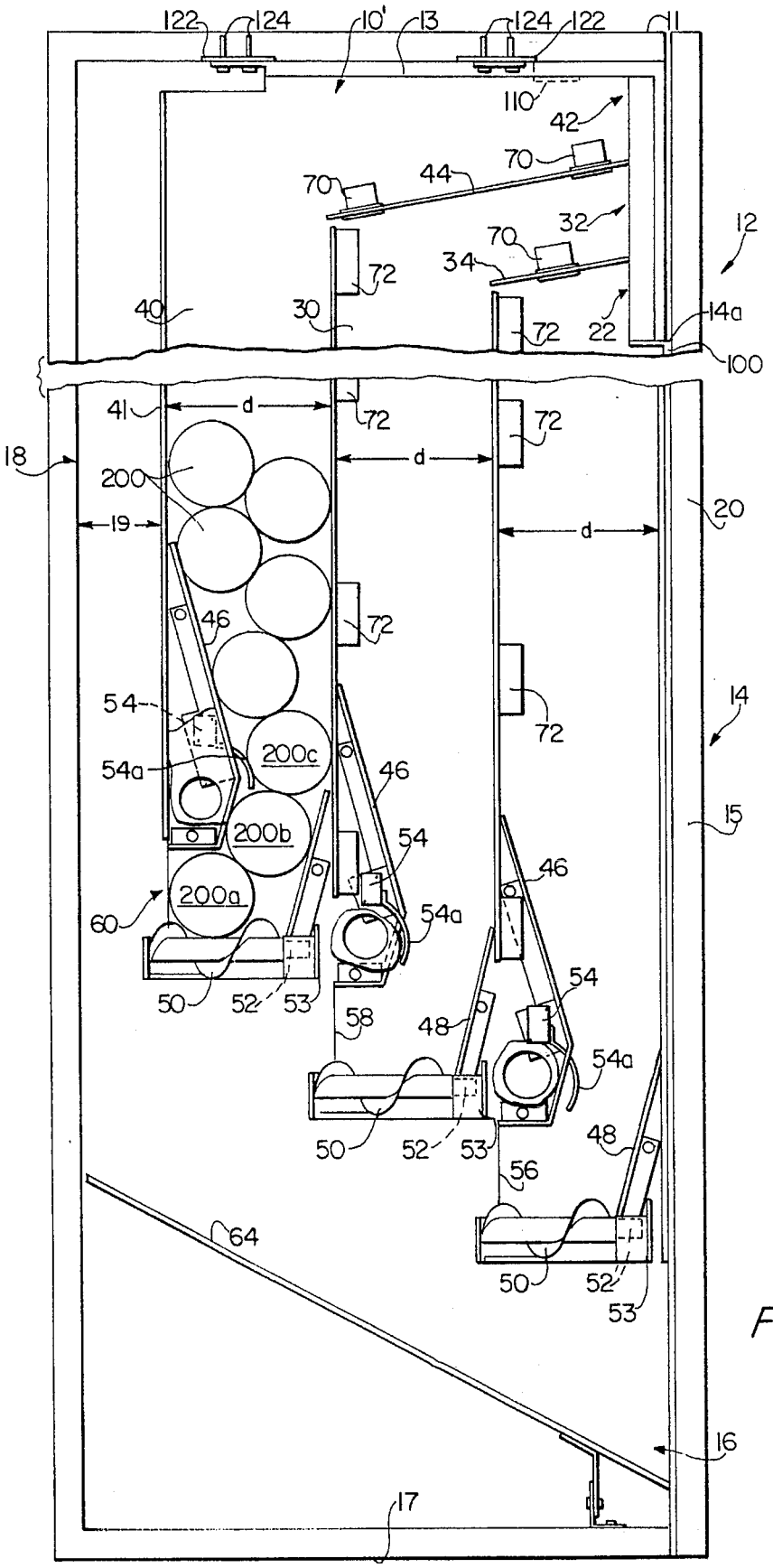
FIG. 1 illustrates a cross-sectional view of the first embodiment of the invention.

In describing preferred embodiments of the present invention illustrated in the drawings, specific terminology is employed for the sake of clarity. However, the invention is not intended to be limited to the specific terminology so selected, and it is to be understood that each specific element includes all technical equivalents which operate in a similar manner to accomplish a similar purpose. The terms front, middle, rear, top, and bottom are used in reference to the orientation of the drawings.

As shown in FIG. 1, the inventive vending mechanism according to the first embodiment of the invention comprises a module 10 for use in a vending machine 12 having a top 11, a bottom 17, a front surface 14, an inner door 15 located at its front surface 14, an outlet port 16 located at bottom 17 of vending machine 12, and an inner rear surface 18.

Module 10 comprises front, middle and rear vertically-extending channels 20, 30, and 40, respectively, arranged front-to-back in parallel relation. Front, middle, and rear channels 20, 30, and 40 have top vend slots 22, 32, and 42, respectively, and outlets 56, 58, and 60 located at the bottom of each channel 20, 30, and 40, respectively. Preferably, module 10 is made of steel.

Each of channels 20, 30, and 40 includes a middle funnel mechanism or ramp 46 and a lower funnel mechanism 48 for funneling multiple columns of cylindrical products 200 to a single column and guiding cylindrical products 200, such as cans, through channels 20, 30, and 40 to their respective outlets 56, 58, and 60.

According to the first embodiment of the invention as shown in FIG. 1, each channel 20, 30, and 40 has a depth "d" of approximately 5 inches to allow double columns or stacks of nested products 200 to be contained therein with their longitudinal axes parallel to the front face 14 of vending machine 12. When used for vending cans from a vending machine provided with six of the inventive modules 10, this embodiment provides a can capacity of about 582 cans; an increased capacity over prior art vend mechanisms of about 35% more cans per cubic foot of refrigerated cabinet space. Alternatively, channels 20, 30, and 40 can be dimensioned to accommodate multiple stacks of other cylindrical products capable of being top-loaded without breaking.

Gap 19 between rear wall 41 of rear channel 40 and inner rear surface 18 of vending machine 12 is preferably about 3.5 inches deep to allow products 200 from rear channel 40 to pass through outlet 60 to chute 64 and outlet port 16.

Figure 4:
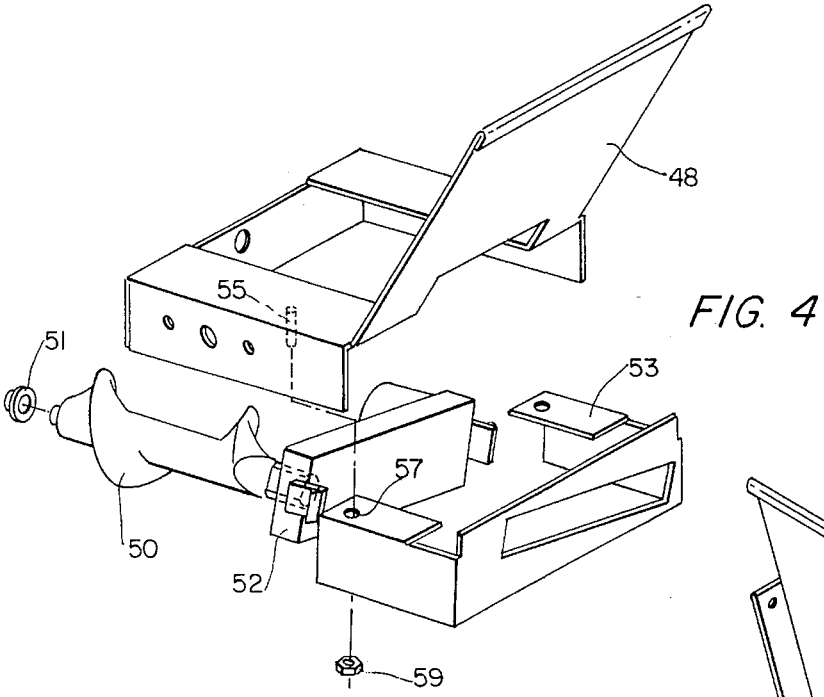
FIG. 4 illustrates an exploded view of the helix and motor.

A helix 50 located at the bottom of each channel 20, 30, and 40 is drivingly connected at one end to a motor 52, preferably a small 24 volt DC motor that operates helix 50 to vend the first (i.e., leading) product 200*a* in a channel whenever a customer deposits the correct amount of money in vending machine 12. As shown in FIG. 4, motor 52 is enclosed in motor mounting bracket 53, which is attached to lower funnel mechanism 48 of each of channels 20, 30, and 40 by a fastener 55 inserted through a hole 57 in motor mounting bracket 53 and secured by a nut 59. At the end opposite motor 52, helix 50 rotates in a bushing 51 inserted in the wall of motor mounting bracket 53. Preferably, helix 50 and motor 52 are plastic.

The event cycle is terminated when an impact sensor (not shown), such as that disclosed in U.S. Pat. No. 5,111,962 to Oden, the contents of which are hereby incorporated by reference, detects that a product 200 has impacted delivery chute 64. Thus, products 200 are vended from channels 20, 30, and 40 by helix 50, which has a pitch slightly larger than the major diameter of the product 200 to be vended.

A sold-out switch mechanism 54 is positioned in each channel 20, 30, and 40 offset from the bottom, substantially level with the position of the third product 200*c*, so that the third product 200*c* rests on actuator bar 54*a* of switch mechanism 54. As is described in greater detail below, actuator bar 54*a* is movable between a depressed, downward position and a released upward position, and is normally biased in the released position. The weight of the third product 200*c* is sufficient to overcome the biasing force and cause actuator bar 54*a* to assume the depressed position.

The sold-out mechanism is de-activated whenever there is no longer a third product 200*c* pressing against actuator bar 54*a* of sold-out switch mechanism 54 in a channel 20, 30, and 40; i.e., the sold-out mechanism is de-activated when there are two products 200*a* and 200*b* remaining in escrow in the channel. This arrangement varies from that conventionally used, in which the actuator bar of the sold-out mechanism is at the very bottom or end of the channel and is held in the depressed position the first product. The conventional arrangement is described in U.S. Pat. No. 3,464,589 to Oden, which is incorporated herein by reference in its entirety. In the conventional arrangement, the sold-out mechanism is deactivated when all products have been vended, so that no products remain in escrow.

Figure 5:
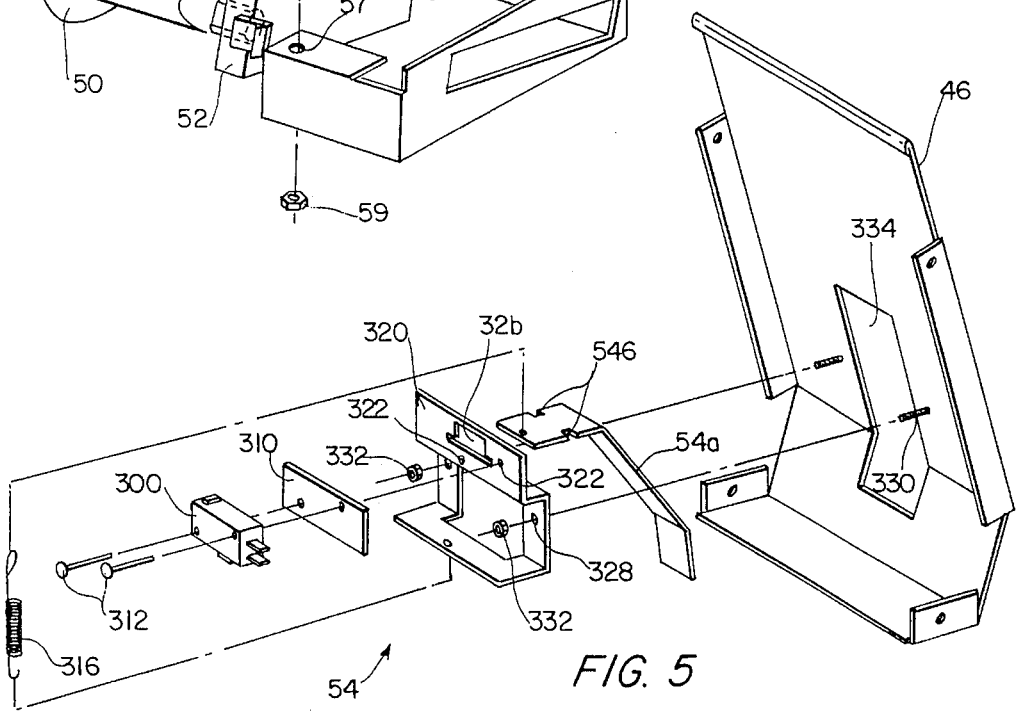
FIG. 5 illustrates an exploded view of the sold out switch.

Switch mechanism 54 of each channel 20, 30, and 40 is preferably a conventional micro-switch. As shown in FIG. 5, switch mechanism 54 includes a sold-out switch 300 and switch insulator 310 attached to a sold-out switch mounting bracket 320 by fasteners 312, preferably number 4 sheet metal screws, inserted through holes 322 in switch mounting bracket 320. Sold out switch mounting bracket 320 has a slot 326 formed therein configured to engage notches 54*b* in actuator bar 54*a*. Actuator bar 54*a* is attached to bracket 320 by engaging notches 54*b* with slot 326. Actuator bar 54*a* is inserted through switching element receiving slot 334 in middle funnel mechanism 46 so that it extends into channel 20, 30, 40 at the position of the third product 200*c*. Bracket 320 is attached to each funnel mechanism 46 by fasteners 330 inserted through holes 328 in bracket 320 and secured by nuts 332. Sold-out spring 316 is attached at one end to actuator bar 54*a* and at its opposite end to switch mounting bracket 320.

Actuator bar 54*a* is spring-biased in a normally upward position. In its normally upward position, actuator bar 54*a* extends forwardly into the position occupied by the third product 200*c*. When the third product 200*c* is present, its weight is sufficient to depress actuator bar 54*a*.

When third product 200*c* depresses actuator bar 54*a*, a circuit in sold-out switch 300 is closed, allowing motor 52 to run to vend a product 200. When only two cans 200*a*, 200*b* remain in escrow at the bottom of a channel 20, 30, 40, actuator bar 54*a* returns to its normally spring-biased upward position, thereby opening the circuit of sold-out switch 300, effectively de-activating sold-out switch 300 and preventing motor 52 from running. Thus, when money is deposited in vending machine 12, motor 52 cannot operate to vend a product 200 and there is no impact on the sensor (not shown) of chute 64.

As described in U.S. Pat. No. 5,111,962 to Oden, when the impact sensor (not shown) does not sense an impact within three seconds of product selection, it activates a sold-out message (not shown) to indicate that the product is sold-out and that channel 20, 30, or 40 needs to be refilled when two products 200*a*, 200*b* remain in escrow at its bottom.

Channels 20, 30, and 40 are reloaded simply by opening inner door 15 at front surface 14 of vending machine 12 and dropping products 200 through vend slots 22, 32, and 42, respectively, so that they fall by gravity to the bottom of channels 20, 30, and 40. Two products 200*a* and 200*b* remaining in escrow at the bottom of channels 20, 30, and 40 absorb the shock of the falling products 200. Therefore, no diverters are necessary to load products 200 into channels 20, 30, and 40. Middle and lower funnel mechanisms 46 and 48 funnel the double stacks of products 200 into a single, generally vertically-extending stack and guide products 200 to each of outlets 56, 58, and 60.

When products 200 are dropped through vend slots 32 and 42, they roll along respective top funnel mechanisms 34 and 44 before dropping by gravity into vertical channels 30 and 40, respectively. Again, the use of diverters is avoided. When products 200 are vended from channels 20, 30, and 40, they are pushed by helices 50 through outlets 56, 58, and 60, respectively, dropped onto chute 64, and vended through outlet port 16 of vending machine 12.

Upwardly extending can guides 70 are inserted into slits (not shown) in left and right column walls 10*a*, 10*b* of module 10 and welded into place in columns 30 and 40. Outwardly extending can guides 72 are inserted into slits (not shown) in left and right column walls 10*a*, 10*b* of module 10 and welded into place in columns 20 and 30. Upwardly extending can guides 70 guide products along top funnel mechanisms 34, 44 of channels 30 and 40, respectively, and outwardly extending can guides 72 guide products through channels 20, 30, and 40 so that products 200 are loaded with their longitudinal axes parallel to front face 14 of vending machine 12.

Figure 3:
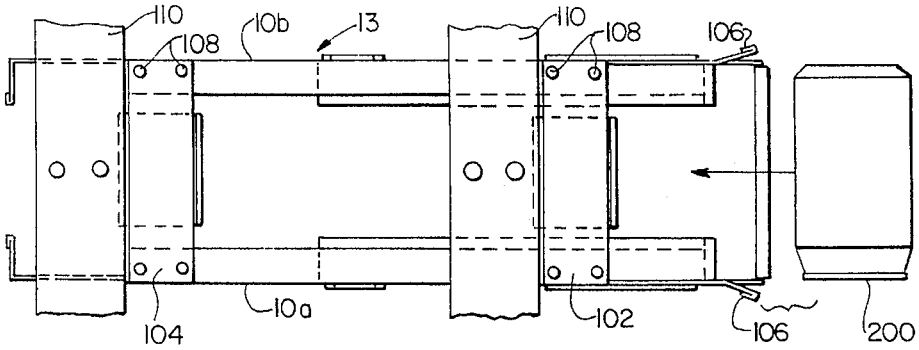
FIG. 3 illustrates a top view of the invention.

As shown in FIG. 3, top 13 of module 10 is welded to module 10 by front, middle, and rear weld strips, 100, 102, 104, respectively, and fasteners 108, preferably pop rivets. Front lead-in can flanges 106 support left and right side walls 10*a*, 10*b*, respectively, of module 10 and guide products 200 through top vend slots 22, 32, and 42 of channels 20, 30, and 40, respectively, so that products 200 can be dropped into top vend slots 22, 32, and 42 with their longitudinal axes parallel to front face 14 of machine 12.

Figure 2:
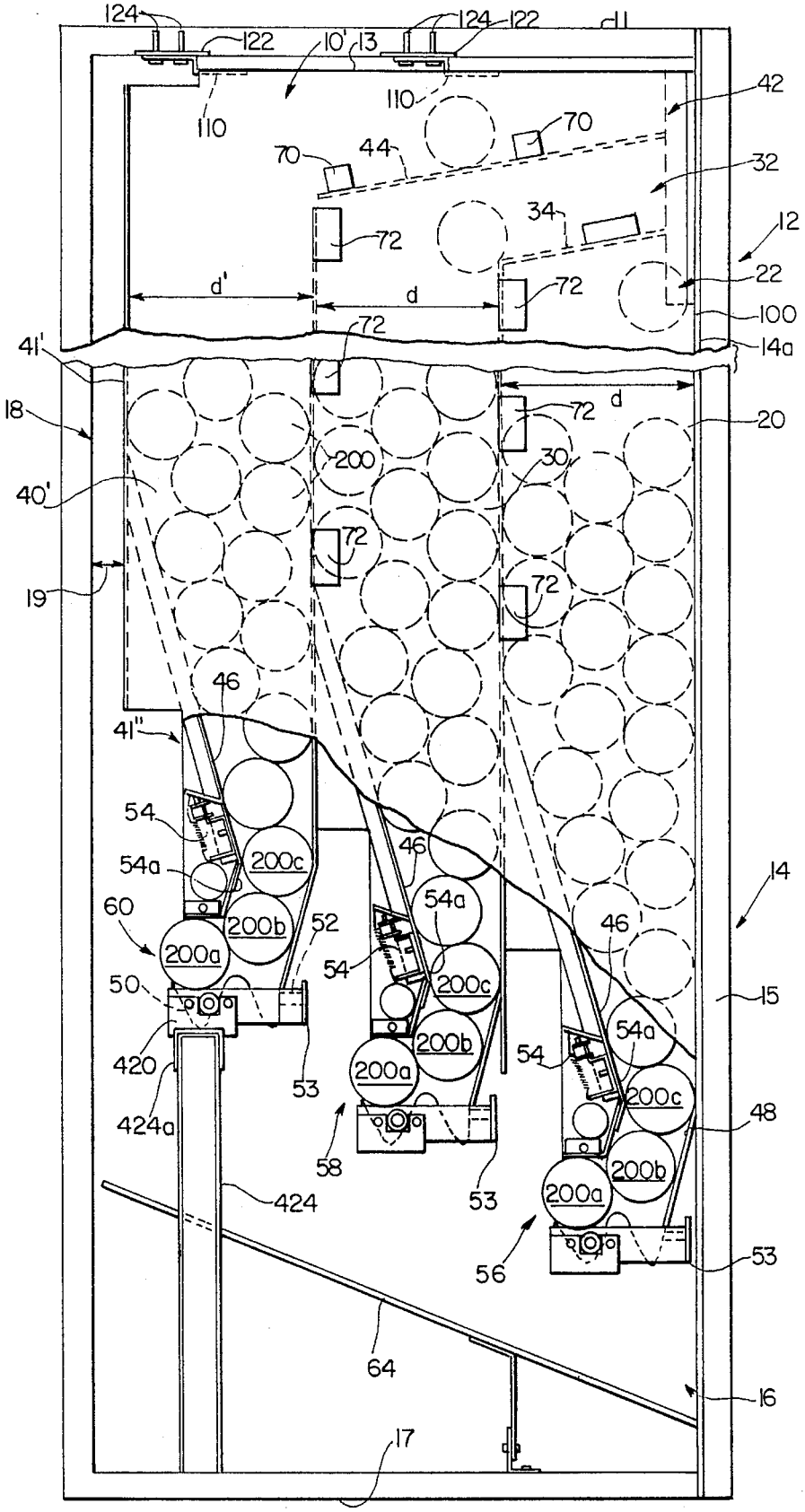
FIG. 2 illustrates a cross-sectional view of the second embodiment of the invention.

Referring now to FIG. 2, there is shown a second embodiment of the invention which is generally similar to the first embodiment except for the configuration and depth of the rear channel, the depths of the front and middle channels, and the lengths of their associated funnel mechanisms.

According to the second embodiment of the invention, as shown in FIG. 2, upper rear wall 41' of rear channel 40' projects outwardly of lower rear wall 41" toward inner rear surface 18 of vending machine 12, so that rear channel 40' has a depth "d'" of approximately 7 inches. Thus, rear channel 40' is dimensioned to accommodate triple rows of nested products 200 having their longitudinal axes parallel to front face 14 of vending machine 12.

Preferably, front and middle channels 20' and 30' are also extended to a depth "d'", although they can remain the same dimensions as in the first embodiment. When the channels are extended, upper funnel mechanisms 46' are lengthened and angled to accommodate the increased depth, to funnel the products from triple to double stacks to single columns or stacks which extend in a generally vertical direction. When used to vend cans from a vending machine provided with six of the inventive modules 10', this embodiment of the invention provides an even greater can capacity of about 636 cans.

Upper gap 19' between upper rear wall 41' of rear channel 40' and inner rear surface 18 of vending machine 12 is about 1.5 inches deep. Lower gap 19" between lower rear wall 41" and rear surface 18 of vending machine 12 is about 3.5 inches deep to allow products 200 to pass through outlet 60 to chute 64 and outlet port 16.

According to the first and second embodiments of the invention, rear channels 40 and 40', respectively, include column wall plate 420, as shown in FIG. 2 in relation to the second embodiment of the invention. Column support 424 extends upwardly from bottom 17 of vending machine 12 and transversely across the width of vending machine 12 and is configured to engage column wall plate 420 at column support brace 424*a*, which is attached to modules 10 and 10', so that modules 10 and 10' each rest on column support 424. Front tie strip 100 of modules 10 and 10' snaps over a bar (not shown) at inner front surface 14*a* of vending machine 12 and column support brackets 110 at top 13 of modules 10 and 10' are attached to tap plates 122 at top 11 of vending machine 12 by fasteners 124, such as ¼-20 bolts. Thus, to assemble modules 10 and 10' in vending machine 12, each module 10 or 10' is inserted into vending machine 12 so that column wall plate 420 of respective rear channel 40 or 40' engages column support 424 of vending machine 12 at column support brace 424*a* and front tie strip 100 engages the bar (not shown) at inner front surface 14*a* of vending machine 12. Column support brackets 110 at top 13 of modules 10 and 10' are attached to tap plates 122 at top 11 of vending machine 12 by fasteners 124 to secure modules 10 and 10' inside vending machine 12.

Modifications and variations of the above-described embodiments of the present invention are possible, as appreciated by those skilled in the art in light of the above teachings. For example, the dimensions of front channel 20 and middle channel 30 could be altered to accommodate single, triple, or multiple stacks of nested products having their longitudinal axes parallel to front face 14 of vender 12, or more channels could be provided for greater product capacity. Also, module 10 and channels 20, 30, and 40 can be dimensioned to accommodate any type of cylindrical product capable of being top-loaded without breaking.

It is therefore to be understood that, within the scope of the appended claims and their equivalents, the invention may be practiced otherwise than as specifically described.

What is claimed is:

1. A vending module for vending cylindrical products to an outlet in the face of a vending machine comprising:

first, second, and third vertical channels having top and bottom ends and being disposed one behind the other in parallel relationship behind the face of the vending machine, said bottom ends of said channels being in communication with the outlet, and said channels being dimensioned to accommodate multiple stacks of products with the longitudinal axes of the products being parallel to the vending machine face;

first, second, and third funnels positioned respectively in said first, second, and third vertical channels to funnel said multiple stacks of products into single, generally vertically-extending stacks of products at said bottom ends;

first, second, and third vend slots in communication with said first, second, and third vertical channels at said top ends of said channels for loading products into said first, second, and third vertical channels;

first, second, and third dispensing means for dispensing the products from said bottom ends of said first, second, and third channels, respectively; and first, second, and third switches operatively connected to said first, second, and third dispensing means, respectively, said first, second, and third switches being operative to de-activate said first, second, and third dispensing means when a pre-determined number n of products greater than zero remains in escrow at said bottom ends of said channels to prevent said first, second, and third dispensing means from dispensing said pre-determined number of products remaining in escrow.

2. The vending module of claim 1, said first, second, and third dispensing means including first, second, and third helices located at said bottom ends of said first, second, and third channels, respectively, each said helix being horizontally disposed, and each said helix having a pitch greater than the diameter of the product to be vender, and each said helix being selectively rotatable for moving a product to be vended out of said channels.

3. The vending module of claim 1, wherein said channels are dimensioned to accommodate nested double stacks of products with the longitudinal axes of the products being parallel to the vending machine face.

4. The vending module of claim 1, wherein said third channel is dimensioned to accommodate nested triple stacks of products with the longitudinal axes of the products being parallel to the vending machine face.

5. The vending module of claim 1, wherein each said switch comprises an actuator bar offset from said bottom of one of said channels substantially level with the position occupied by the nth+1 product, said actuator bar being movable between a depressed, activated position and a released, de-activated position, said actuator bar being normally biased in said released, de-activated position.

6. The vending machine of claim 5, wherein n equals 2.

7. A vending machine having a face, an outlet in said face, and a plurality of vending modules housed side-by-side therein in parallel relation behind said face, each of said vending modules comprising:

first and second vertical channels having top and bottom ends and being disposed one behind the other in parallel relation behind the face of the vending machine, said bottom ends of said channels being in communication with said outlet, and said channels being dimensioned to accommodate stacks of cylindrical products with the longitudinal axes of the products being parallel to said vending machine face;

first and second vend slots in communication with said first and second vertical channels at said top ends of said channels for loading products into said first and second vertical channels;

first and second dispensing means for dispensing the products from said bottom ends of said first and second channels, respectively; and first and second switches operatively connected to said first and second dispensing means, respectively, said first and second switches being operative to deactivate said first and second dispensing means when a pre-determined number n of products greater than zero remains in escrow at said bottom ends of said channels to prevent said first and second dispensing means from dispensing said pre-determined number of products remaining in escrow.

8. The vending machine of claim 7, further comprising first and second funnels positioned respectively in said first and second vertical channels to funnel said multiple stacks of products into single, generally vertically-extending stacks of products at said bottom ends.

9. The vending machine of claim 7, wherein said first and second dispensing means comprise first and second rotatable helixes located at said bottom ends of said first and second channels, respectively, each said helix being horizontally disposed, and each said helix having a pitch greater than the diameter of the product to be vended, and each said helix being selectively rotatable for moving a product to be vended out of said channels.

10. The vending machine of claim 7, wherein said channels are dimensioned to accommodate nested double stacks of products with their longitudinal axes being parallel to the vending machine face.

11. The vending machine of claim 10, wherein one of said channels is dimensioned to accommodate nested triple stacks of products with the longitudinal axes of the products being parallel to the vending machine face.

12. The vending machine of claim 7, wherein there are six of said vending modules.

13. The vending machine of claim 7, wherein n equals 2.

14. A vending module for vending cylindrical products to an outlet in the face of a vending machine comprising:

first, second, and third vertical channels having top and bottom ends and being disposed in parallel relationship behind the face of the vending machine, said bottom ends of said channels being in communication with the outlet, said top ends being open for loading products therein, and said channels being dimensioned to accommodate multiple stacks of products with the longitudinal axes of the products being horizontally disposed;

first, second, and third funnels positioned respectively in said first, second, and third vertical channels to funnel said multiple stacks of products into single, generally vertically-extending stacks of products at said bottom ends;

first, second, and third helices located at said bottom ends of said first, second, and third channels, respectively, each said helix having a pitch greater than the diameter of the product to be vended, and each said helix being selectively rotatable for moving a product to be vended out of said channels; and first, second, and third switches operatively connected to said first, second, and third helixes, respectively, said first, second, and third switches being operative to deactivate said first, second, and third helixes when a pre-determined number n of products greater than zero remains in escrow at said bottom ends of said channels to prevent said first, second, and third helixes from dispensing said pre-determined number of products remaining in escrow.

15. The vending module of claim 14, wherein said channels are dimensioned to accommodate nested double stacks of products with the longitudinal axes of the products being parallel to the vending machine face.

16. The vending module of claim 14, wherein said third channel is dimensioned to accommodate nested triple stacks of products with the longitudinal axes of the products being parallel to the vending machine face.

17. The vending machine of claim 14, wherein n equals 2.

18. The vending machine of claim 17, wherein each said helix is horizontally disposed.

* * * * *